US005647175A

United States Patent [19]

Smyth

[11] Patent Number: 5,647,175

[45] Date of Patent: Jul. 15, 1997

[54] FLOATING SUB-FRAME FOR ROOF CURBS AND METHOD OF INSTALLATION

[76] Inventor: James G. Smyth, 9709 Barkridge Rd., Charlotte, N.C. 28227

[21] Appl. No.: 565,297

[22] Filed: Nov. 27, 1995

[51] Int. Cl.[6] ..... E04B 1/343; E04B 7/16

[52] U.S. Cl. ..... 52/58; 52/1; 52/200; 52/536; 52/537; 52/656.1; 52/656.2; 52/656.9; 52/745.15; 52/745.16; 52/745.19; 52/745.2; 52/573.1

[58] Field of Search ..... 52/537, 200, 1, 52/58, 656.1, 656.2, 656.9, 745.15, 745.16, 745.19, 745.2, 396.04

[56] References Cited

U.S. PATENT DOCUMENTS 1,792,704 2/1931 Peverley ..... 52/200 X
3,828,494 8/1974 Urhane et al. ..... 52/537 X
4,480,534 11/1984 Sloan ..... 52/200 X
4,559,753 12/1985 Brueske ..... 52/200 X
5,027,576 7/1991 Gustavsson ..... 52/537 X
5,053,266 10/1991 Hesketh et al. ..... 52/58 X

*Primary Examiner*—Christopher T. Kent
*Attorney, Agent, or Firm*—Clifton Ted Hunt

[57] ABSTRACT

A floating sub-frame for installation on purlins of a metal roof beneath a roof curb that supports roof equipment. The floating sub-frame functions to stabilize the roof curb by resisting vertical movement of the roof due to the passage of wind across the roof while enabling horizontal thermal movement of the metal roof relative to the supporting purlins.

9 Claims, 11 Drawing Sheets

FLOATING SUB-FRAME FOR ROOF CURBS AND METHOD OF INSTALLATION

FIELD OF THE INVENTION

This invention relates to pre-engineered metal buildings and standing seam roofs (sometimes known as floating standing seam roofs), and more specifically to the support of HVAC equipment, skylights, and other roof equipment on the metal roof of a pre-engineered building or on a standing-seam roof.

BACKGROUND OF THE INVENTION

Standing seam roofs on pre-engineered metal buildings are formed of sheet metal (conventionally 24 gauge metal). The standing seam roof is supported by a sliding roof clip attached to purlins. Purlins are Z-shaped strips of metal (conventionally 14 gauge metal) supported by the building's outer walls and inner pavilions.

Many pre-engineered buildings are built with equipment installed on the roof, such as HVAC equipment, skylights, and the like (herein called roof equipment). Roof equipment is frequently installed while the pre-engineered building is being built, but may be subsequently installed on an existing roof by making an opening in the roof surrounded by a roof curb to support the equipment.

Roof curbs are used in the installation of roof equipment on a metal roof. Roof curbs are metal frames that are conventionally installed on stationary sub-framing supposed by the purlins to serve as supports for items of roof equipment. An item of roof equipment is conventionally mounted in sealed relation to the roof curb and the sheet metal roofing is installed on fixed stationary sub-framing that is attached to the purlins. Stationary sub-framing for roof curbs does not allow for thermal movement of the metal roofing panels.

Changes in temperature frequently cause sufficient thermal movement of the sheet metal roofing to loosen the weatherproof seals and result in undesirable leakage of water through the roof. The weatherproof seals are also loosened, resulting in leakage, when the roof is lifted from the purlins by sufficient negative pressure being created by the passage of wind across the roof.

One manufacturer of metal buildings uses the traditional method of fixed sub-framing but does not fasten the roof curb to the sub-framing. Instead, the 24 gauge roof panels are welded to the 14 gauge flange of the roof curb, with the expectation that the roof curb and the equipment it supports will move with the roof but thermal movement of the metal roof panels, caused by expansion and contraction of the metal roof panels due to changes in temperature, results in slotting or tearing of the lighter gauge roof panel and undesirable leaking.

To applicant's knowledge, there is nothing in the prior art that resists vertical uplift of a metal roof while enabling a roof curb to move as a metal roof moves in response to changes in thermal conditions.

SUMMARY OF THE INVENTION

It is an object of this invention to provide a method and apparatus to minimize the risk of water leakage through a metal roof by enabling thermal movement of the roof while at the same time resisting uplift of the roof due to the negative pressure created above the roof by the passage of wind.

It is a more specific object of the invention to provide a floating sub-frame for installation on purlins of a metal roof beneath a roof curb that supports roof equipment. The floating sub-frame functions to stabilize the roof curb by resisting vertical movement of the roof due to the passage of wind across the roof while enabling horizontal thermal movement of the metal roof relative to the supporting purlins.

The floating sub-frame of this invention includes two span channels and two cross channels. The span channels extend between two spaced purlins at the intended location of an item of roof equipment, and the two cross channels extend between the span channels in parallel relation to the purlins. The floating sub-frame also includes four internal sliding stirrups at the junctures of the two span channels with the two purlins, and four uplift retainer collars at the ends of the two span channels. Rail clips are factory welded to the stirrups to raise the roof curb assembly to the same elevation as the standing seam roof.

The two span channels and the two cross channels are dimensioned to fit directly beneath the roof curb when installed. The internal sliding stirrups are built to permit thermal movement of the span channels with the metal roof panels (a floating sub-frame) and the stirrups are fastened to the purlins between notched portions of the span channels. The uplift retainer collars lock the span channels to the internal sliding stirrups to resist uplift caused by negative pressure resulting from high winds.

All components of the sub-frame are pre-engineered, manufactured, and assembled at the factory to match the structural details of the building and of the roof curb. Information for making the sub-frame to coincide with the building and roof curb is obtained from a detail/order form developed for use with this invention. The detail/order form is used by the metal building manufacturer or by a construction contractor to obtain a specifically pre-engineered sub-frame for a specific roof curb to be installed in a specific pre-engineered building to support a specific item of roof equipment. The specific sub-frame that is manufactured in accordance with the detail/order form is shipped as a unit from the factory to the building site and installed as received, without the need for assembly by the building contractor.

DETAILED DESCRIPTION OF THE INVENTION

Figure 1:
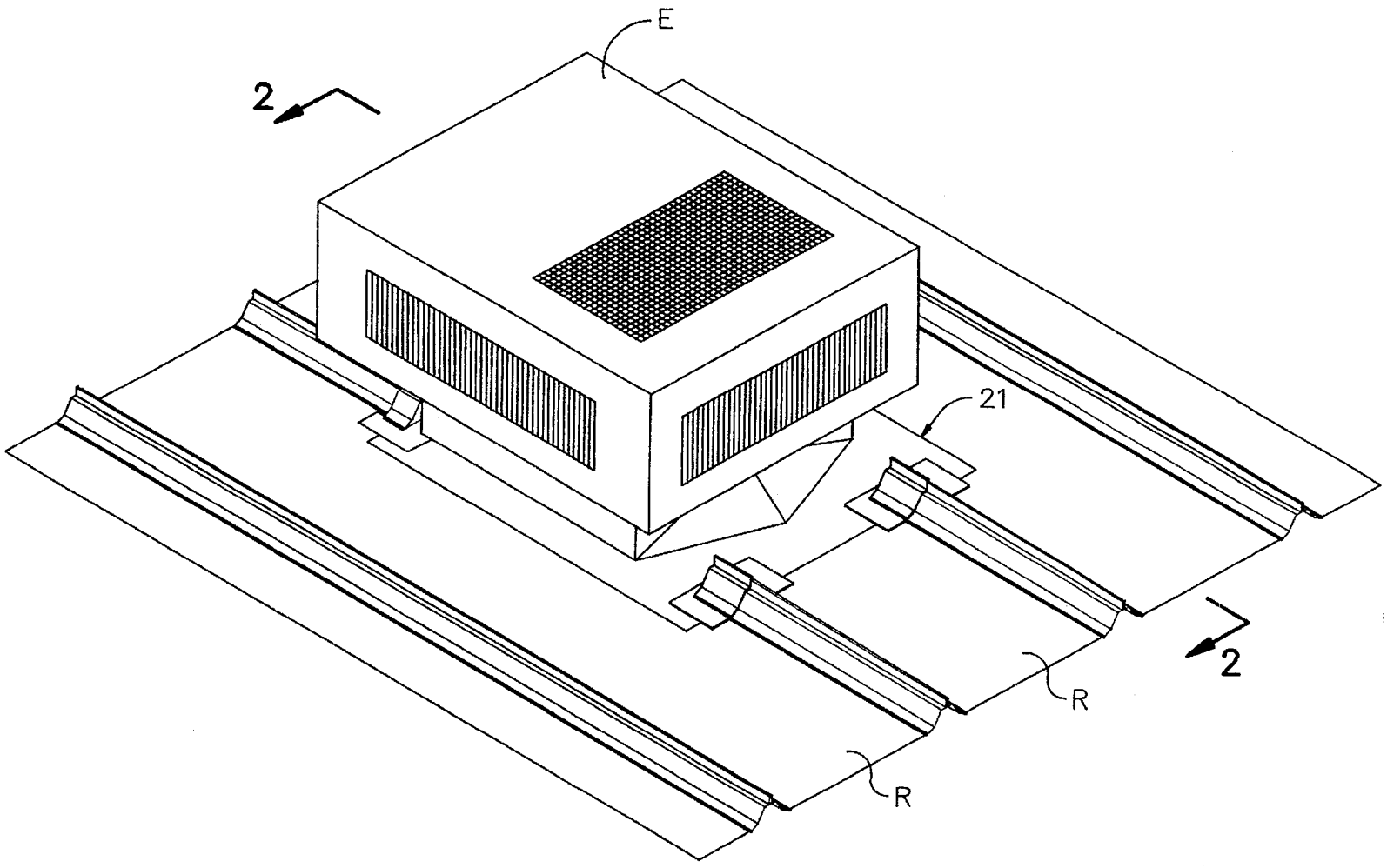
FIG. 1 is a perspective view looking at the standing seam roof of a pre-engineered metal building with an item of roof equipment installed on the roof.
Figure 2:
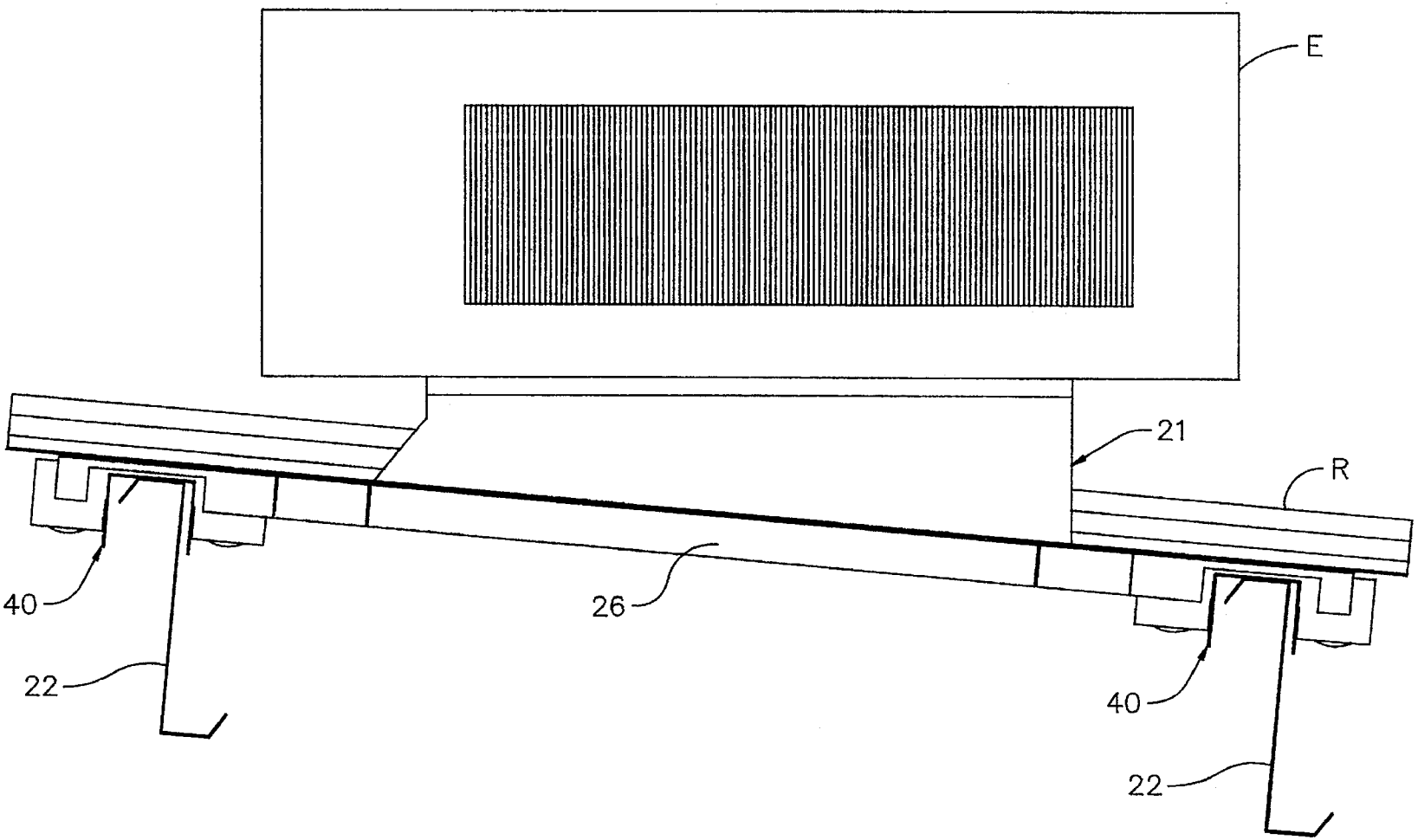
FIG. 2 is a sectional view taken substantially along the line 2—2 in FIG. 1.

Referring more specifically to the drawings, the sub-frame of this invention, broadly indicated at 20, is built for use with a roof curb 21 that supports roof equipment such as air conditioners on spaced purlins 22 in the roof structure of a pre-engineered metal building or on adjoining purlins 22 in a standing seam roof. An air conditioner is illustrative of the many kinds of roof equipment supported by roof curbs and the reference character 23 is used to designate roof equipment generally.

The manufacture of roof curbs is a sub-industry that services the manufacturers and builders of pre-engineered metal buildings. The sub-frame of this invention, broadly indicated at 20, is a novelty in that industry. Roof curbs, such as indicated at 21, are sturdy steel frames that are conventionally joined to adjoining sub-framing attached to purlins 22 of pre-engineered metal buildings at locations where an item of roof equipment 23 is to be installed. Each floating sub-frame 22 is formed with specific dimensions to correspond with the dimensions and spacing of the specific purlins 22 to which the roof curb is to be joined. Each roof curb 21 is also formed with the specific dimensions needed to conform with the dimensions of the specific item of roof equipment 23 to be supported on the roof curb.

According to the invention, the sub-frame 20 fits between the purlins 22 and the roof curb 21. The sub-frame 20 is fastened to the roof curb and slidably connected to two spaced purlins 22. Each sub-frame 20 is custom made with dimensions that conform with the dimensions of a specific roof curb 21 and with the dimensions and spacing of specific purlins 22 in a specific roof.

Figure 3:
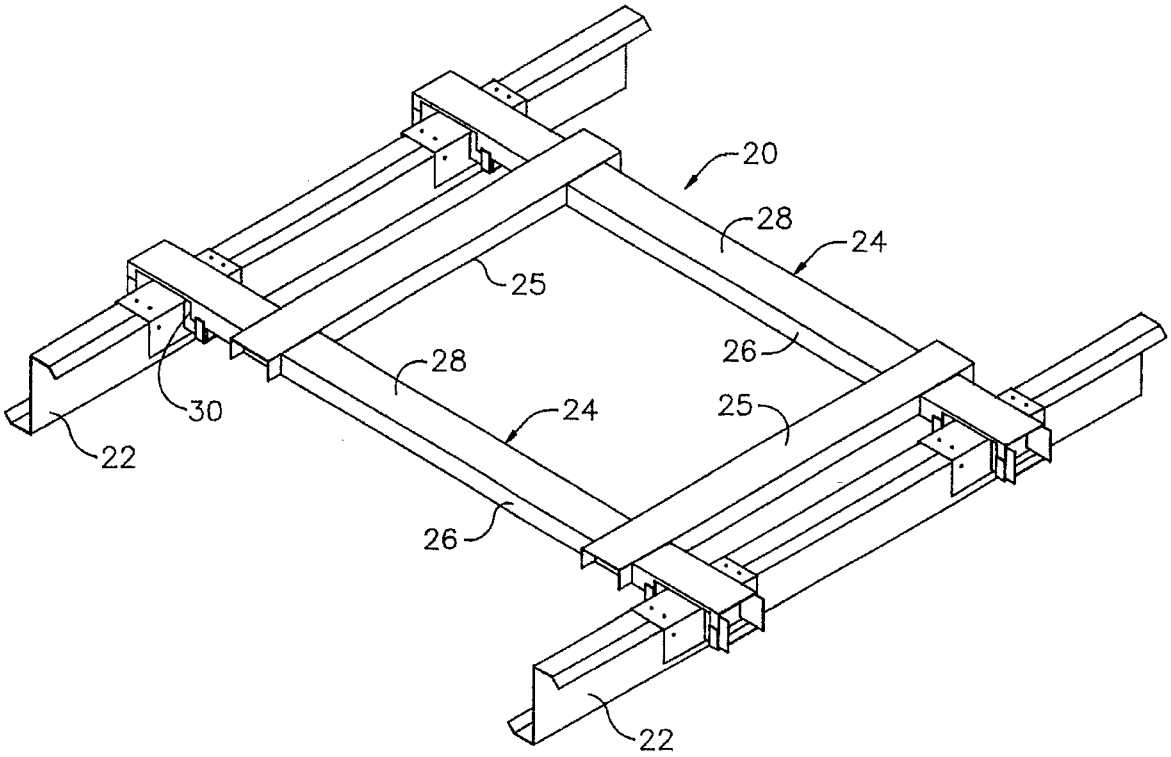
FIG. 3 is a perspective view of the floating sub-frame, alone, assembled on purlins.
Figure 3A:
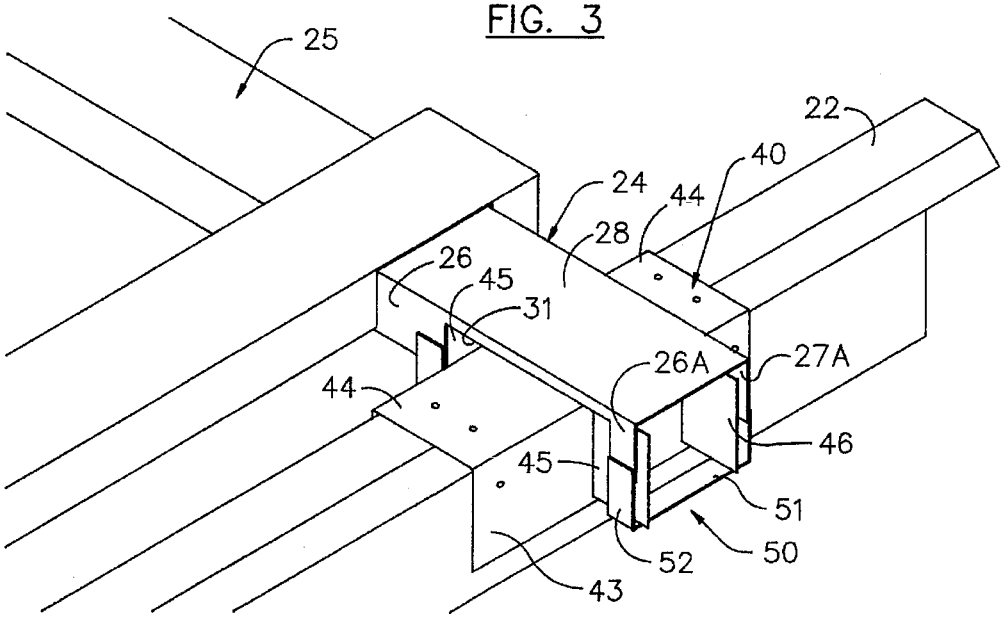
FIG. 3A is an exploded fragmentary view, with parts broken away, of the lower right corner of the floating sub-frame and purlins in FIG. 3.
Figure 4:
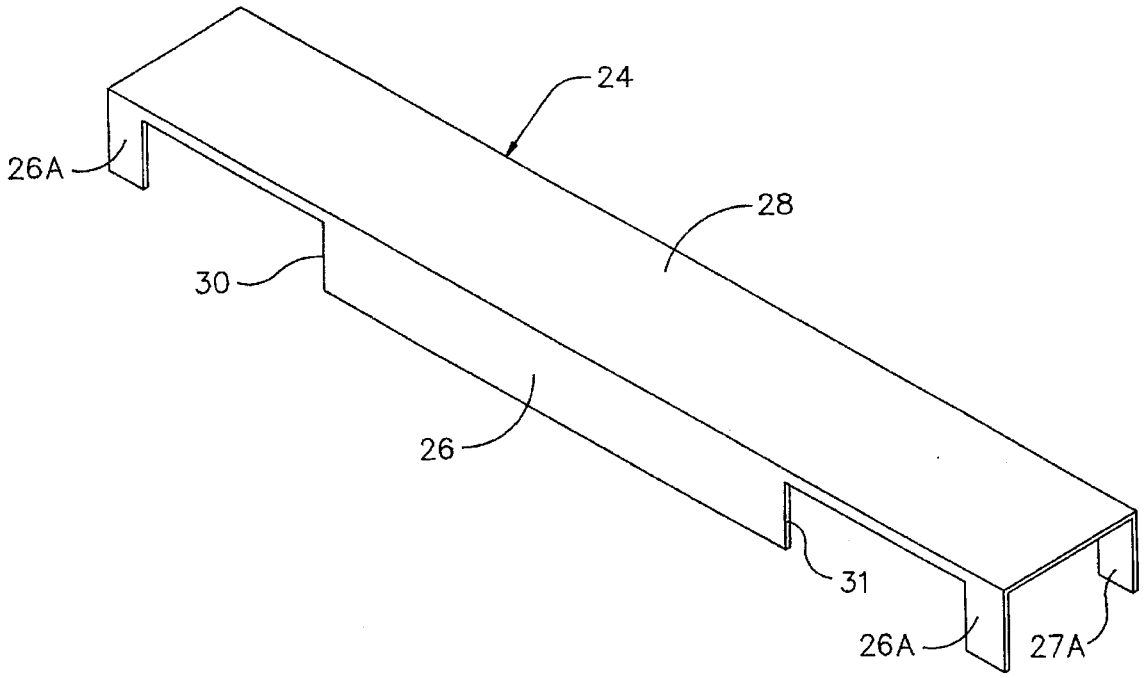
FIG. 4 is a perspective view of one of the span channels removed from the floating sub-frame of FIG. 3.
Figure 4A:
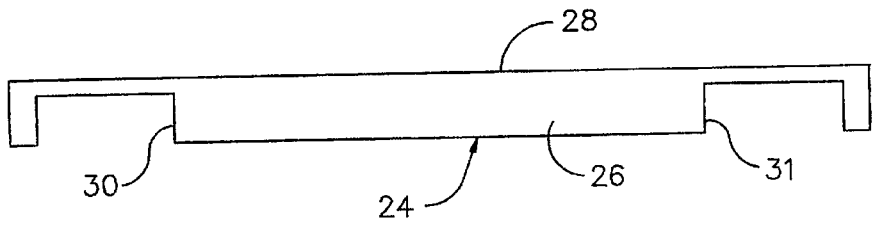
FIG. 4A is a side view of the span channel shown in FIG. 4.
Figure 4B:
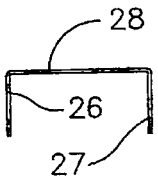
FIG. 4B is an end view of the span channel shown in FIG. 4.
Figure 5:
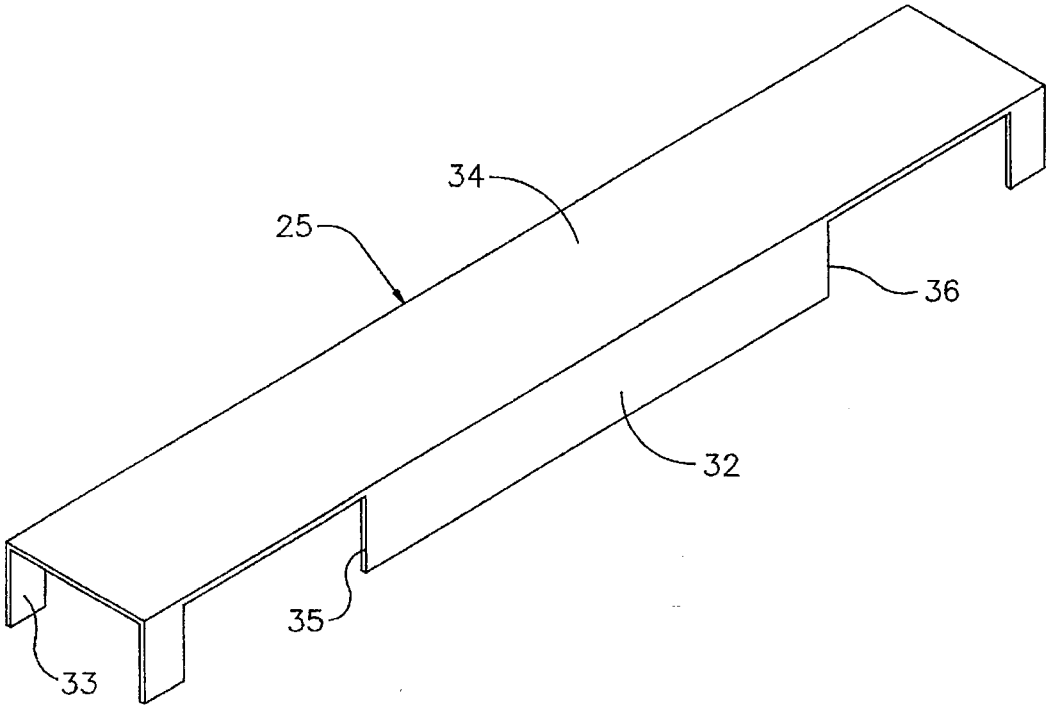
FIG. 5 is a perspective view of one of the cross channels removed from the sub-frame of FIG. 3.
Figure 5A:
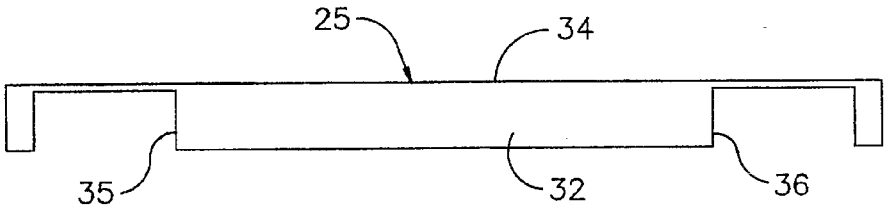
FIG. 5A is a side view of the cross channel shown in FIG. 5.
Figure 5B:
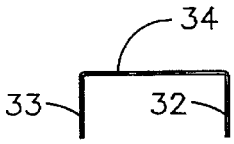
FIG. 5B is an end view of the cross channel shown in FIG. 5.

Referring to FIGS. 3, 4, and 5, the sub-frame 20 comprises a pair of span channels 24 and a pair of cross channels 25. The span channels 24 extend in parallel relation to each other between the two purlins 22 in FIG. 3, and the cross channels 25 extend in parallel relation to each other and in parallel relation to the purlins 22 between the span channels 24.

The span channels 24 are of inverted U-shaped cross-sectional configuration in use, including parallel side walls 25 and 26 joined by a top wall 27. The side walls 25 and 26 of the span channels are cut away to define cut-out portions as at 30 and 31 that fit over spaced purlins 22. The span channels are formed to conform with the dimensions and spacing of the purlins with which it is intended to use the sub-frame 20.

The cross channels 25 are also of inverted U-shaped cross-sectional configuration in use, and include parallel side walls 32 and 33 joined by a top wall 34. The side walls 32 and 33 of the cross channels are cut away as at 35 and 36 to fit over the span channels 24. The cross channels 25 are formed with the cut away portions 35 and 36 spaced apart a distance corresponding to the internal dimension of the specific roof curb 21 with which the sub-frame 20 is intended to be used.

Figure 6:
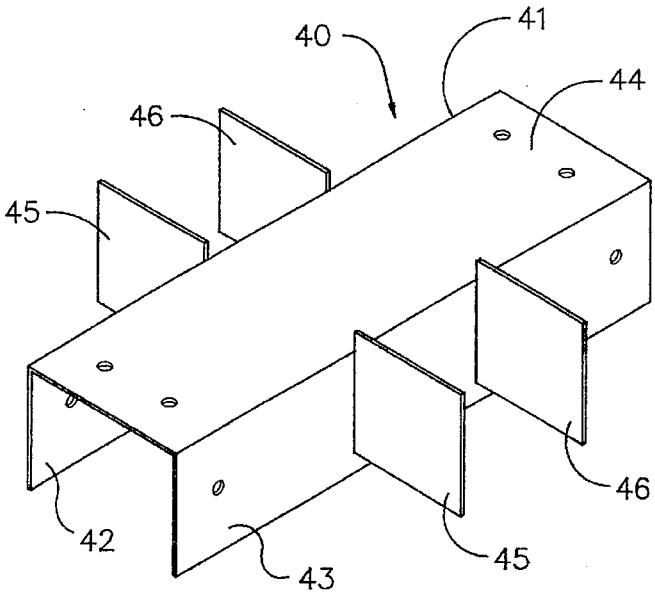
FIG. 6 is a perspective view of one embodiment of the internal sliding stirrup removed from the floating sub-frame of FIG. 3.

FIG. 6 shows an internal sliding stirrup, broadly indicated at 40, removed from the sub-frame 20. The internal sliding stirrup 40 comprises a relatively short U-shaped channel 41 that is inverted in use and defined by side walls 42 and 43 joined by a top wall 44. A pair of stirrup rail clips 45 are welded in alinement with each other to the side walls 42 and 43 and extend perpendicularly therefrom at a height to correspond with the height of the clips on the sub-frame and the plane of the finished roof elevation. Another pair of stirrup rail clips 46 are welded in alinement with each other to the side walls 42 and 43 and extend perpendicularly therefrom.

Figure 6A:
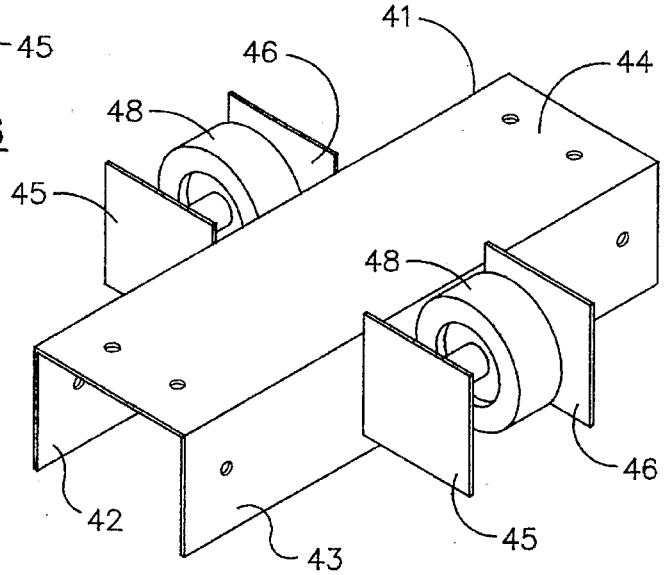
FIG. 6A is a perspective view of a second embodiment of the internal sliding stirrup removed from the floating sub-frame of FIG. 3.

Referring to FIG. 6A, a second embodiment of the internal sliding stirrup uses rail clips 45, 46 to journal rollers 48 that are positioned to support the installed roof curb at an elevation that corresponds with that of the standing seam roof. The rollers 48 permit movement of the roof curb, with thermal movement of the metal roof, without the friction generated when the roof curb is supported by the rail clips.

In use, as best seen in FIG. 3, the internal sliding stirrups 40 are fastened to the purlins 22 before the span channels 24 of the sub-frame 20 are installed. The channels 41 of the stirrups 40 are positioned in parallel relation with the purlins and fastened to the purlins with the top wall 44 of the channel on top of the purlin and the side walls 42, 43 of the channel 41 extending along the sides of the purlin.

The span channels 24 are then positioned in place with the cut away portions 30 and 31 in the side walls 26, 27 extending across the top walls 44 of the internal sliding stirrups 40. The span channels are positioned between the sets of rail clips 45 and 46. The cut away portions 30 and 31 are longer than the width of the top wall 44 on the internal sliding stirrups 40, enabling thermal movement of the metal roof panels R, the roof equipment 23, the roof curb 21, and the span channels 24 of the sub-frame 20 relative to the purlins 22, to which the internal sliding stirrups are secured.

Figure 7:
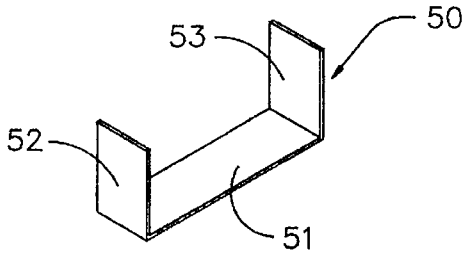
FIG. 7 shows multiple views of one of the retainer collars removed from the sub frame of FIG. 3.

Uplift retainer collars 50 (FIG. 7) are used to resist lifting of the roof panels R by negative pressure caused by the passage of high winds across the roof. The uplift retainer collar 50 is a U-shaped piece of metal with a web 51 extending horizontally between the lower ends of two vertically extending legs 52 and 53 in FIGS. 3 and 7.

End portions 26A and 27A of the side walls 26, 27 on the span channels 24 extend beyond the cut away portions 30, 31, and beyond the purlins 22 when the sub-frame 20 is assembled on the purlins.

The uplift retainer collars 50 are welded to the end portions 26A and 27A after the collars are positioned with the webs 51 extending beneath the outermost rail clips 45, 46 of the internal sliding stirrups 40, and with the legs 52 and 53 extending upwardly against the end portions 26A, 27A on the span channels 24.

Installation

FIGS. 8–12 illustrate the steps to be taken in installing a roof curb on the sub-frame of this invention. The first step after the purlins have been installed is to install metal roofing panels to the location of the roof equipment. This enables the workmen to carry the components of the sub-frame and roof curb to the location of use without having to travel the narrow purlins.

Figure 8:
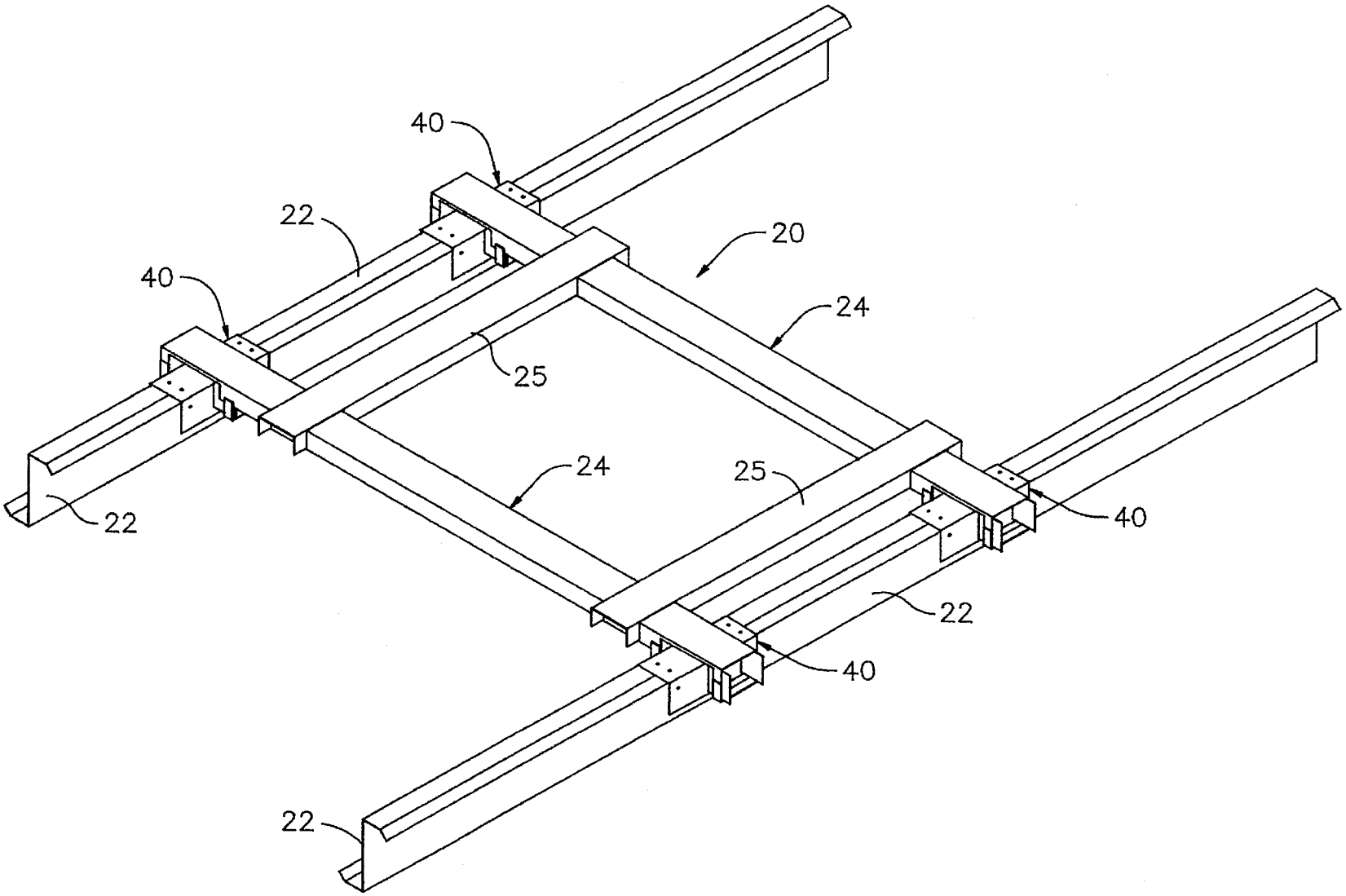
FIGS. 8–12 are sequential views illustrating the assembly of a roof curb and complementary sub-frame on purlins.

FIG. 8 illustrates the first step in the installation. A sub-frame 20 that has been especially built for this location is placed on spaced purlins 22. The first step in doing this is to fasten the internal sliding stirrups to the spaced purlins. Then, the span channels 24 are positioned in the internal sliding stirrups on the purlins and the uplifter retainer collars 50 are fastened in place with the web 51 beneath the outer rail clips 46 on the stirrups 40 and the upstanding legs 52, 53 welded to the end portions 26A, 27A of the span channels. The cut away portions 35 and 36 of the cross channels 25 are then fitted over the span channels 24, as shown in FIG. 8.

Figure 9:
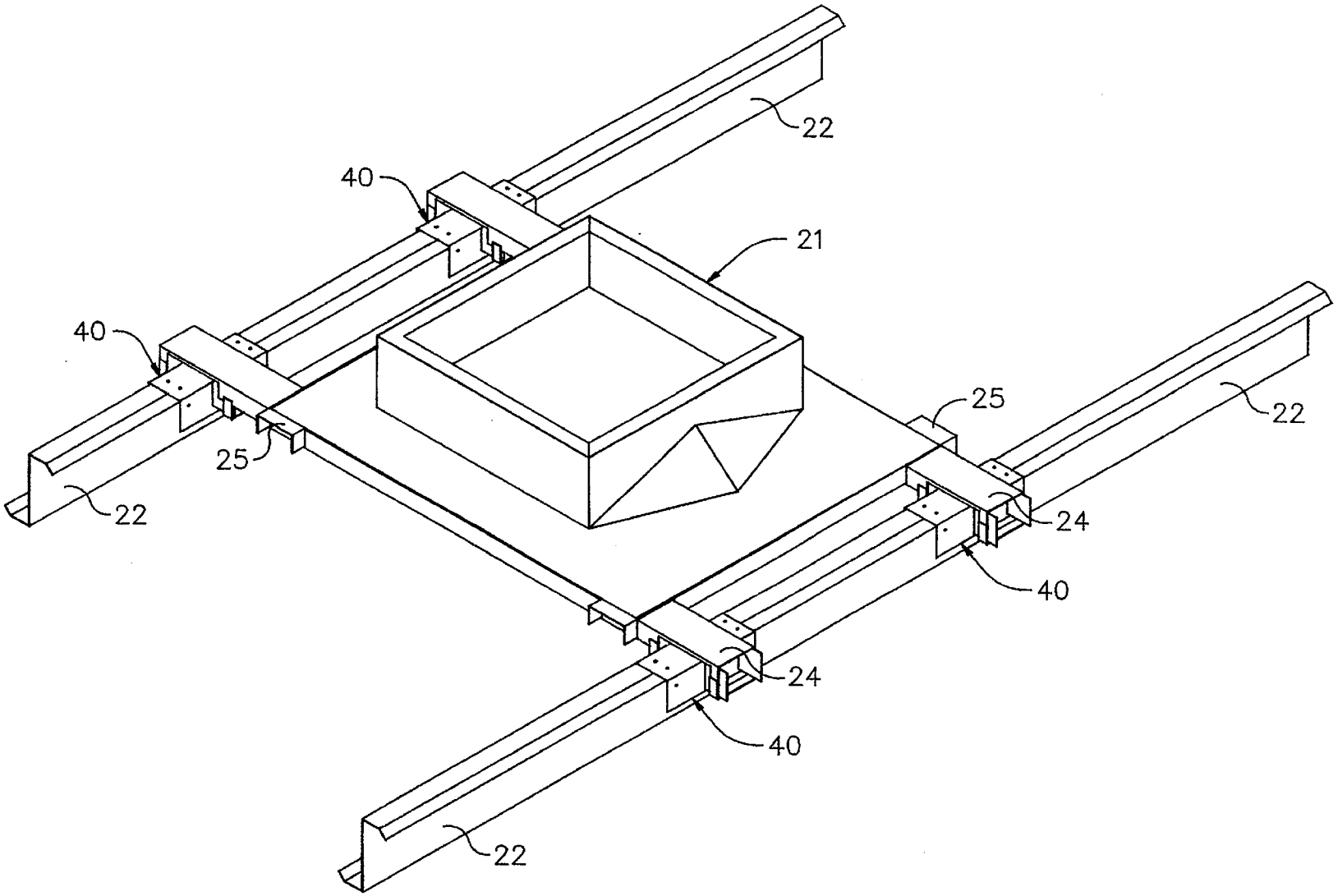

After the sub-frame 20 is installed on the purlins, a roof curb 21 is placed on the sub-frame, as shown in FIG. 9. The roof curb 21 is built with specific dimensions to conform with the sub-frame and the item of roof equipment to be supported on the roof curb. The roof curb 21 is positioned on the sub-frame 20 with the inner dimensions of the roof curb aligned with the inner dimensions of the sub-frame.

Figure 10A:
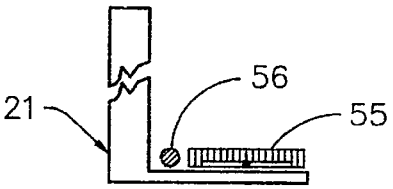
FIG. 10A is a sectional view taken substantially along the line 10A—10A in FIG. 10.
Figure 10:
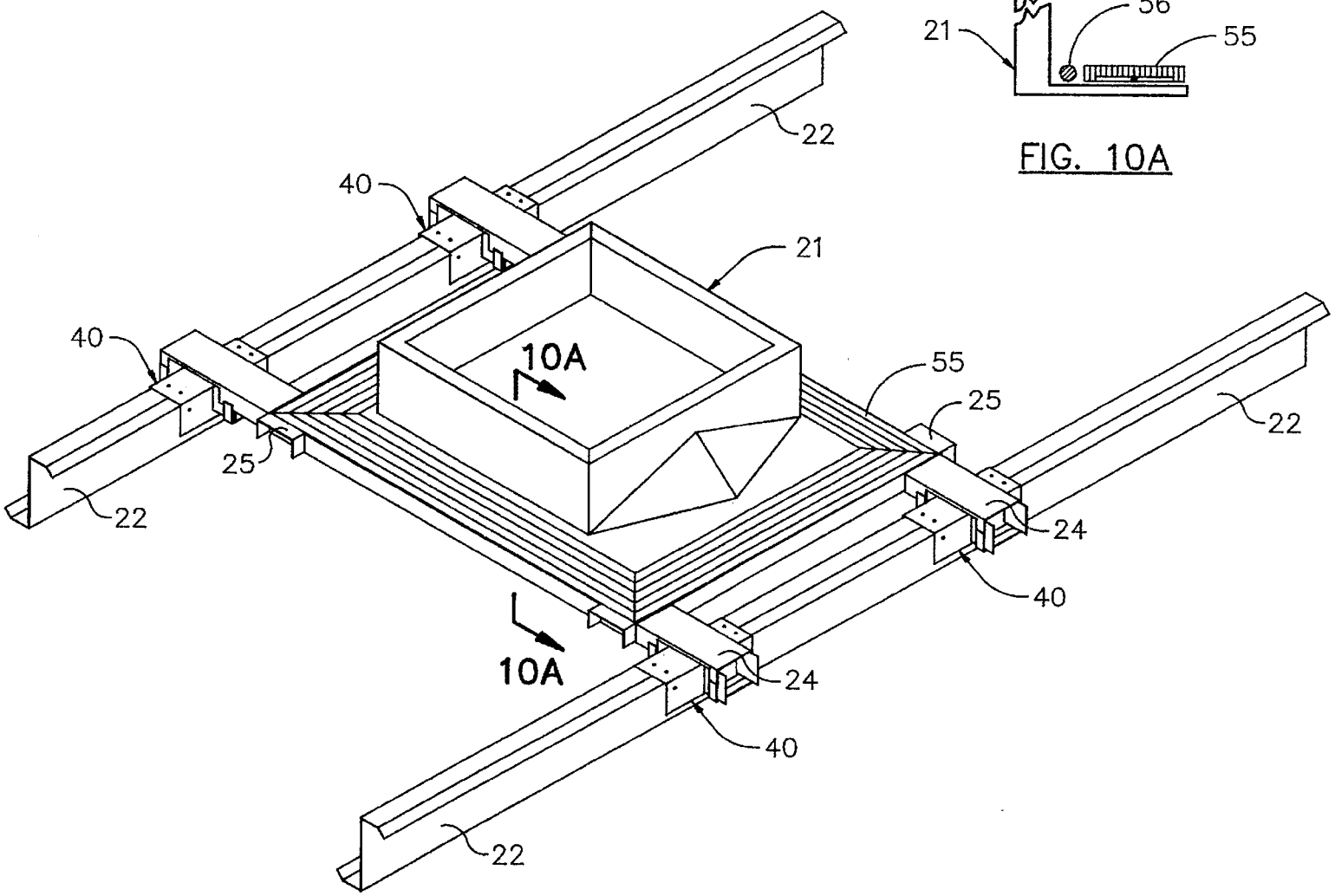

The next step, as seen in FIG. 10, is to apply tape caulk 55 around the outside flange of the roof curb, and then apply tube caulk 56 around the perimeter of the roof curb, inside the tape caulk, as shown in FIG. 10A.

Figure 11:
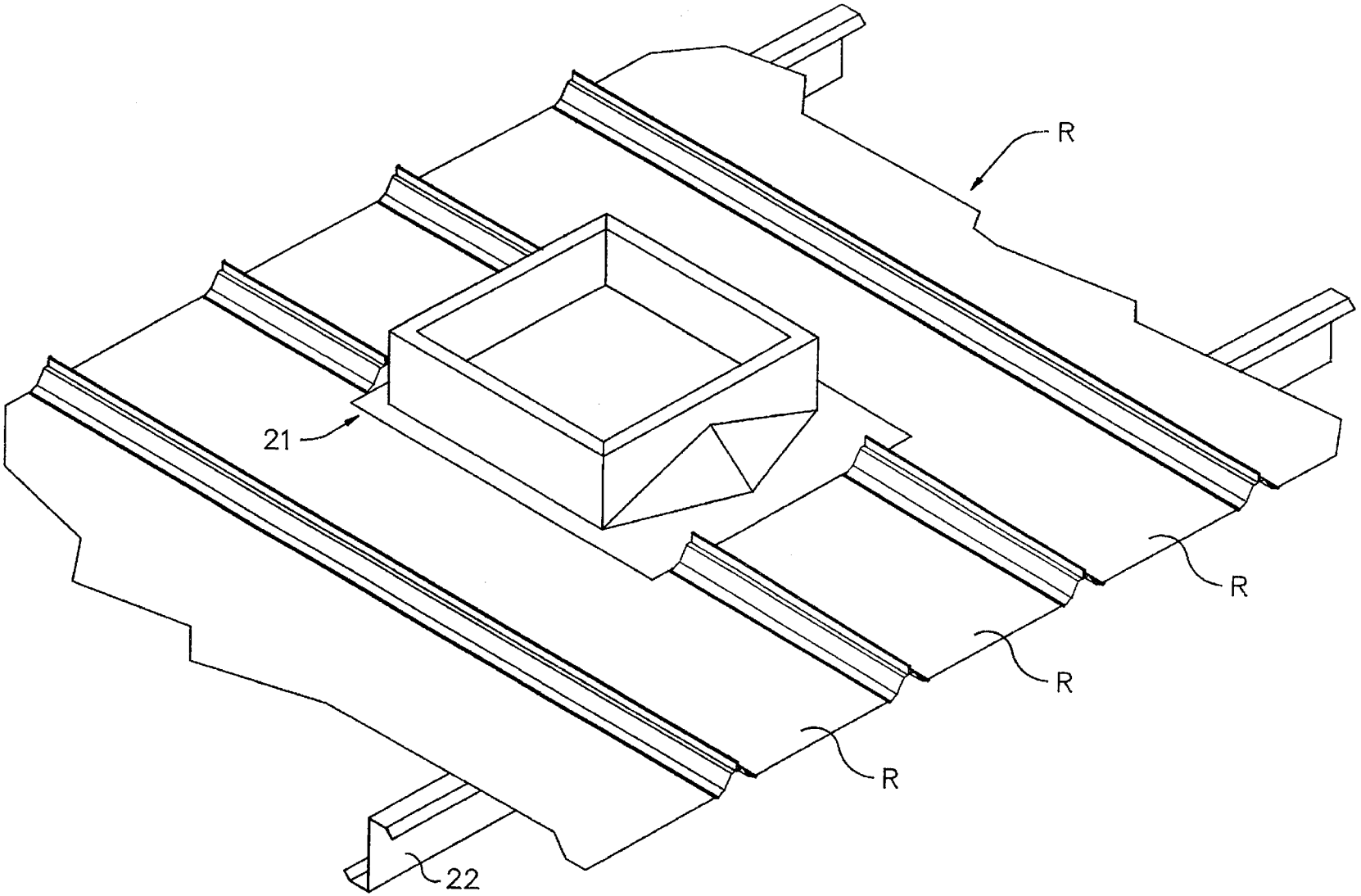

Then, as shown in FIG. 11, the metal roof panels R are attached to the purlins in spaced relation to the roof curb 21. The roof panels are spaced six inches from the upper edge of the curb and one and a half inches from the lower edge of the curb.

Figure 12:
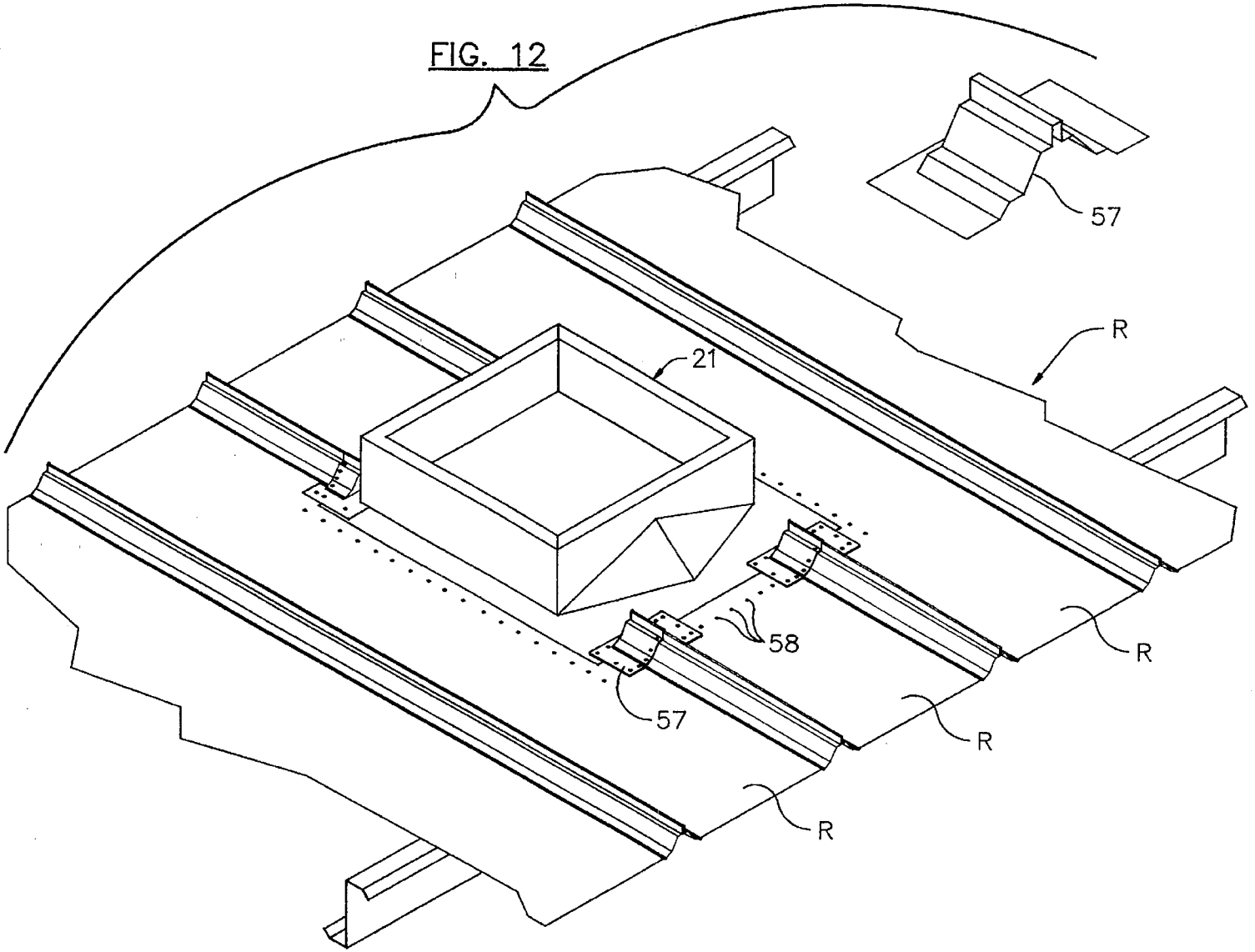

FIG. 12 illustrates the final steps of attaching the roof panels to the curb 21. This is done conventionally with rib closures 57 sealed in place and with screws 58 spaced apart no more than four inches on center.

There is thus provided a novel sub-frame for roof curbs that enables thermal movement of the roof panels while restricting vertical uplift of the roof panels by negative pressure caused by high winds.

Although specific terms have been used in describing the invention they have been used in a generic and descriptive sense only and not for the purpose of limitation, the scope of the invention being defined in the following claims to invention.

I claim:

1. A floating sub-frame for a roof curb to be installed as support for roof equipment at a selected location on a standing seam roof of a pre-engineered metal building having purlins and a stationary frame supporting metal roof panels and the roof curb having dimensions to conform with the dimensions and spacing of the purlins, said sub-frame comprising:

(a) a pair of span channels for installation between two spaced purlins at the selected location of the roof curb, each of said span channels having cut-out portions being spaced from each other a distance for corresponding to the spacing of said purlins;

(b) a pair of cross channels extending between the span channels at the selected location of the roof curb;

(c) means enabling movement of the sub-frame, roof curb and roof equipment with thermal movement of the metal roof panels, said means enabling movement of the sub-frame being coupled to said span channels and said cross channels;

(d) means resisting uplift of the metal roof panels by any negative pressure created above the roof by the passage of high winds, said means resisting uplift of the metal roof panels being located on said span channels; and (e) means preventing ponding of water at the juncture of said channels the metal roof panels with the roof curb.

2. The invention of claim 1 wherein said means enabling movement of the sub-frame, roof curb and roof equipment with thermal movement of the metal roof panels comprises internal sliding stirrups, means connecting an internal sliding stirrup in each cut-out in the span channels, and means for fastening the internal sliding stirrups to said spaced purlins in use.

3. The invention of claim 2 wherein the means for preventing ponding of water at the juncture of the roof panels with the roof curb comprises a plurality of rail clips on each internal sliding stirrup for bringing the elevation of the installed roof curb to the elevation of the standing seam roof.

4. The invention of claim 2 wherein the means for preventing ponding of water at the juncture of the roof panels with the roof curb comprises a plurality of rollers on each internal sliding stirrup for bringing the elevation of the installed roof curb to the elevation of the standing seam roof.

5. The invention of claim 3 wherein said means resisting uplift of the metal roof panels is an uplift retainer collar fastened to each end of each span channel in underlying relation to one of the rail clips on a corresponding internal sliding stirrup.

6. A sub-frame for a roof curb to be installed as support for roof equipment at a selected location on a standing seam roof or at a selected location on the roof of a pre-engineered metal building having purlins and a stationary frame supporting metal roof panels and the roof curb having dimensions to conform with the dimensions and spacing of the purlins and with the dimensions of the roof equipment, said sub-frame comprising:

(a) a pair of span channels for installation between spaced purlins at the selected location of the roof curb, each of said span channels having cut-out portions spaced from each other a distance for corresponding to the spacing of said purlins;

(b) a pair of cross channels extending between the span channels at the selected location of the roof curb;

(c) an internal sliding stirrup positioned within each cut-out in the span channels;

(d) means extending from each internal sliding stirrup to equalize the height of the installed roof curb with the height of the standing seam roof; and (e) an uplift retainer collar secured to each end of each span channel in underlying relation to a rail clip extending from the corresponding internal sliding stirrup.

7. The invention of claim 6 wherein the means extending from each internal sliding stirrup is a plurality of rail clips.

8. The invention of claim 6 wherein the means extending from each internal sliding stirrup is a plurality of rollers.

9. The method of supporting a roof curb for thermal movement with metal roof panels on a standing seam roof of a pre-engineered metal building having purlins while resisting uplift of the roof curb and roof panels by negative pressure caused by the passage of high winds across the roof, said method comprising the steps of:

(a) providing a floating sub-frame including:

(i) span channels extending between two purlins;

(ii) cross channels extending between the span channels;

(iii) internal sliding stirrups positioned between the span channels and the purlins, each stirrup including at least one roller supporting the roof curb at a pre-selected elevation to conform with the elevation of the standing seam roof; and (iv) uplift retainer clips welded to the span channels and in underlying relation to the stirrups.

* * * * *